US005376060A

United States Patent [19]

Murray

[11] Patent Number: 5,376,060

[45] Date of Patent: Dec. 27, 1994

[54] SWIMMING SIMULATOR

[76] Inventor: John J. Murray, 30-1 Chase Ct., Ossining, N.Y. 10562

[21] Appl. No.: 106,532

[22] Filed: Aug. 16, 1993

[51] Int. Cl.[5] ..... A63B 69/10

[52] U.S. Cl. ..... 482/56; 482/112; 482/130; 482/142; 434/254; 601/33

[58] Field of Search ..... 482/55, 56, 112, 123, 482/130, 142; 434/254; 601/24, 34, 33, 35; 5/226, 229; 606/242, 245

[56] References Cited

U.S. PATENT DOCUMENTS

| | | | |
|---|---|---|---|
| 350,932 | 10/1886 | Keating | 482/56 |
| 2,033,275 | 3/1936 | Campbell | 482/56 |
| 2,332,184 | 10/1943 | Sweeney | 482/56 |
| 3,589,715 | 6/1971 | Mark et al. | 482/142 |
| 4,422,634 | 12/1983 | Hopkins | 482/901 |
| 4,674,740 | 6/1987 | Iams et al. | 482/901 |
| 4,830,363 | 5/1989 | Kennedy | 434/254 |
| 4,948,119 | 8/1990 | Robertson, Jr. | 482/56 |
| 5,282,748 | 2/1994 | Little | 434/254 |

FOREIGN PATENT DOCUMENTS

| | | | |
|---|---|---|---|
| 961723 | 9/1982 | U.S.S.R. | 482/56 |

*Primary Examiner*—Richard J. Apley
*Assistant Examiner*—Jeanne M. Mollo

[57] ABSTRACT

A new and improved swimming simulator includes a base support assembly and a pair of arm exercising assemblies attached to the base support assembly. A pair of leg exercising assemblies is attached to the base support assembly. Each of the leg exercising assemblies includes a leg-supporting member pivotally connected to a first portion of the base support assembly. Each of the leg exercising assemblies also includes an extensible and retractable hydraulic cylinder and piston assembly which supports a portion of the leg-supporting member and which is connected to the base support assembly. A bench assembly is attached to the base support assembly and includes a bendable top member, a spring assembly located under the bendable top member and supported by the base support assembly, and a horizontal support member supporting the bendable top member. A user lies down on the bench assembly. The horizontal support member is supported by the base support assembly, such that a first portion and a second portion of the bendable top member are elevated and lowered by the spring assembly with respect to a third portion of the bendable top member which is supported by the horizontal support member. Each spring assembly is comprised of a butterfly spring assembly. A water container may be attached to the base support assembly and positioned at one end of the bendable top member.

3 Claims, 4 Drawing Sheets 43
41
29
17
85
45
35
37
4
31
47
31
33
31

47
43
31
87
45

SWIMMING SIMULATOR

BACKGROUND OF THE INVENTION

1. Field of the Invention

The present invention relates generally to fitness equipment, and, more particularly, to fitness equipment that simulates swimming.

2. Description of the Prior Art

Swimming can be approached as being a competitive sport, and it can also be approached as being an excellent activity to be carried out for exercise. Because of the requirement for large amounts of water that is treated with chemicals to assure a healthful nature of the water, many persons cannot participate in swimming as much as they would like. In this respect, swimming simulators have been developed. More specifically, throughout the years, a number of innovations have been developed relating to swimming simulators, and the following U.S. Pat. Nos. are representative of some of those innovations: 4,422,634; 4,674,740; 4,844,450; and 4,948,119.

More specifically, U.S. Pat. No. 4,422,634 discloses a swimming simulator that includes hand grips that rotate in a circular pattern and leg levers that have a predetermined resistance. The pattern of movement of the hands is limited to rotational movement with this apparatus. This is not desirable because real swimming requires hand motions that deviate from a purely rotational motion. In this respect, it would be desirable if a swimming simulation device were provided which permits a range of hand motion that is more diverse than a purely rotational motion.

U.S. Pat. No. 4,674,740 also discloses a swimming simulator which provides hand grips that rotate in a circular pattern.

U.S. Pat. No. 4,844,450 discloses a swimming simulator that employs hand grips attached to cables which drive a flywheel. Similarly, leg-driven elements drive a second flywheel. A disadvantage of using flywheels is that they tend be too easy to use because of the momentum conserved by the respective flywheels. To expend more energy with a swimming simulator, it would be desirable if the swimming simulator does not employ flywheels which conserve momentum.

U.S. Pat. No. 4,948,119 discloses a swimming simulator that orients the user in a seated position. Hand grips are employed to pull cables which pull spring-loaded reels. The legs, however, are not exercised. In reality, when a person swims, the person is in a supine position, not a seated position. In this respect, it would be desirable if a swimming simulation device were provided with hand grips attached to cables that wind and unwind reel assemblies and were also provided with a table to permit the person to be oriented in a supine position.

U.S. Pat. No. 4,560,160 may be of interest for its disclosure of another exercise device for swimmers.

Still other features would be desirable in a swimming simulator. For example, although prior art swimming simulator provide for ways to exercise arms and legs, none of the prior art devices specifically provides for exercising a person's torso. In this respect, it would be desirable if a swimming simulation device were provided the has specific provisions for exercising a person's torso.

More specifically, when a person is swimming, the person's torso expands and contracts when breathing.

Specific muscles involved in chest expansion would be additionally exercised if a swimming simulator were provided with a device that provided specific resistance during chest expansion. In this respect, it would be desirable if a swimming simulation device were provided that provides specific resistance to chest muscles during chest expansion.

Many of the prior art swimming simulator provide for exercise and coordination of arm and leg motion that occur during swimming. However, the prior art devices fail to provide simulation for an important aspect of swimming; that is, coordinating head and neck motion with arm motion to provide for alternately inhaling fresh air and exhaling used air. More specifically, none of the prior art swimming simulator provide a small quantity of water that permits a user to practice and simulate inhaling fresh air and exhaling used air in the water to more accurately simulate the act of swimming.

Actual swimming can take place in a number of water environments. The water can be saline such as in an ocean. The water can be fresh such as in a lake. The water can be chlorinated, such as in a swimming pool. To truly simulate a real swimming environment, it would be desirable that the small quantity of water that is used for swimming simulation be appropriately treated so as to simulate a selected water environment.

Thus, while the foregoing body of prior art indicates it to be well known to use swimming simulation devices, the prior art described above does not teach or suggest a swimming simulator which has the following combination of desirable features: (1) permits a range of hand motion that is more diverse than a purely rotational motion; (2) does not employ flywheels which conserve momentum; (3) is provided with hand grips attached to cables that wind and unwind reel assemblies and is also provided with a table to permit the person to be oriented in a supine position; (4) has specific provisions for exercising a person's torso; (5) provides specific resistance to chest muscles during chest expansion; (6) permits a user to practice and simulate inhaling fresh air and exhaling used air in water to more accurately simulate the act of swimming; and (7) has a small quantity of water that is used for swimming simulation and that can be appropriately treated so as to simulate a selected water environment. The foregoing desired characteristics are provided by the unique swimming simulator of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved swimming simulator which includes a base support assembly and a pair of arm exercising assemblies attached to the base support assembly. Each of the arm exercising assemblies includes a spring-biased winding/unwinding assembly. A cable is connected to the spring-biased winding/unwinding assembly, and a hand grip is connected to the cable. A pair of leg exercising assemblies is attached to the base support assembly. Each of the leg exercising assemblies includes a leg-supporting member pivotally connected to a first portion of the base support assembly. Each of the leg exercising assemblies also includes an extensible and retractable support assembly which supports a portion of the leg-supporting member and which is connected to the base support assembly. The extensible and retractable support assemblies for the leg-supporting members include hydraulic cylinder and piston assemblies.

A bench assembly is attached to the base support assembly. The bench assembly includes a bendable top member, a spring assembly located under the bendable top member and supported by the base support assembly, and a horizontal support member supporting the bendable top member. The horizontal support member is supported by the base support assembly, such that a first portion and a second portion of the bendable top member are elevated and lowered by the spring assembly with respect to a third portion of the bendable top member which is supported by the horizontal support member.

Each spring assembly is comprised of a butterfly spring assembly which includes a first wing portion positioned under the first portion of the bendable top member. A second wing portion is positioned under the second portion of the bendable top member, and a spring portion is connected between the first wing portion and the second wing portion, for biasing upward motion of and for resisting downward motion of the first wing portion and the second wing portion and the spring portion, for biasing upward motion of and for resisting downward motion of the first portion and the second portion of the bendable top member.

A water container may be attached to the base support assembly and positioned at one end of the bendable top member. The water container permits a user's face to alternately be immersed in water and be removed from water, in simulation of alternating facial contact with water such as occurs in actual swimming.

A dispenser compartment may be attached to the water container, for receiving a quantity of a chemical additive, for dissolution in water in the water container.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved swimming simulator which has all of the advantages of the prior art and none of the disadvantages.

It is another object of the present invention to provide a new and improved swimming simulator which may be easily and efficiently manufactured and marketed.

It is a further object of the present invention to provide a new and improved swimming simulator which is of durable and reliable construction.

An even further object of the present invention is to provide a new and improved swimming simulator which is susceptible of a low cost of manufacture with regard to both materials and labor, and which accordingly is then susceptible of low prices of sale to the consuming public, thereby making such swimming simulator available to the buying public.

Still yet a further object of the present invention is to provide a new and improved swimming simulator which permits a range of hand motion that is more diverse than a purely rotational motion.

Still another object of the present invention is to provide a new and improved swimming simulator that does not employ flywheels which conserve momentum.

Yet another object of the present invention is to provide a new and improved swimming simulator which is provided with hand grips attached to cables that wind and unwind reel assemblies and is also provided with a table to permit the person to be oriented in a supine position.

Even another object of the present invention is to provide a new and improved swimming simulator that has specific provisions for exercising a person's torso.

Still a further object of the present invention is to provide a new and improved swimming simulator which provides specific resistance to chest muscles during chest expansion.

Yet another object of the present invention is to provide a new and improved swimming simulator that permits a user to practice and simulate inhaling fresh air and exhaling used air in water to more accurately simulate the act of swimming.

Still another object of the present invention is to provide a new and improved swimming simulator which has a small quantity of water that is used for swimming simulation and that can be appropriately treated so as to simulate a selected water environment.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 7 is an enlarged perspective view of the circled area 7 in FIG. 5, wherein FIG. 7 shows a chemical dispensing chamber.

DESCRIPTION OF THE PREFERRED EMBODIMENT

Figure 1:
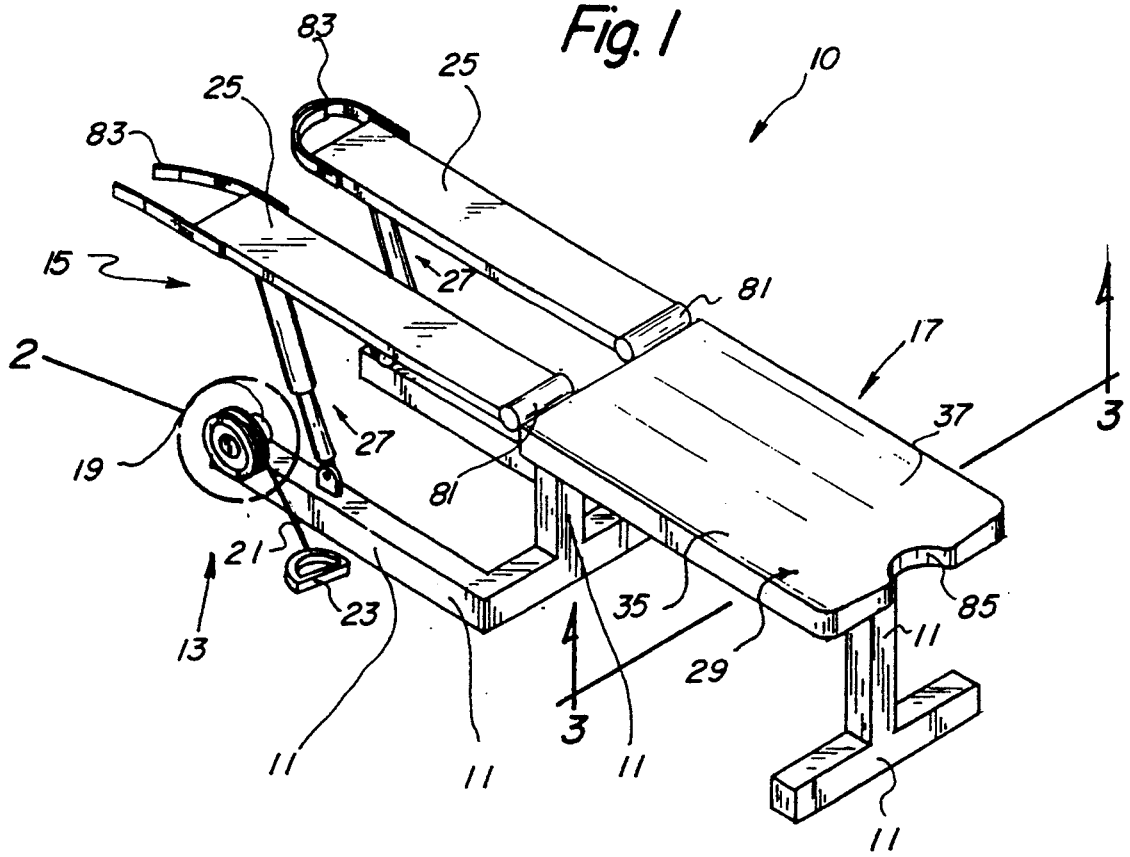
FIG. 1 is a perspective view from above showing a first preferred embodiment of the swimming simulator of the invention.
Figure 2:
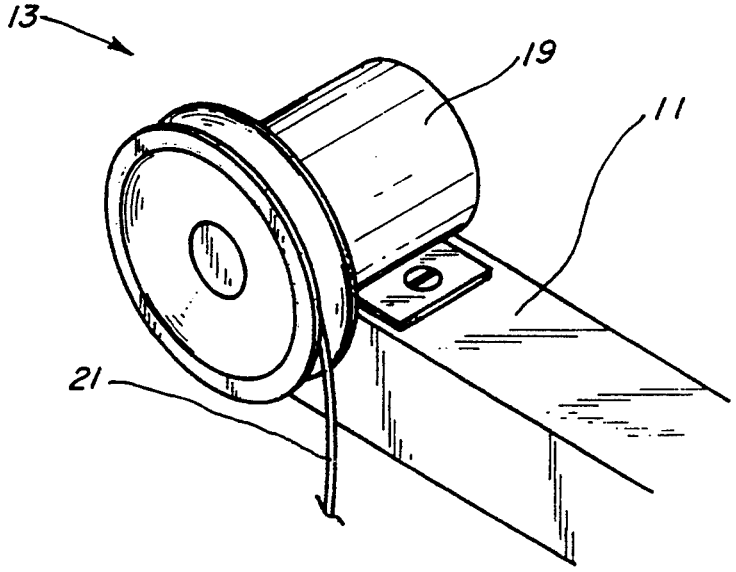
FIG. 2 is an enlarged perspective view of a winding and unwinding assembly for a hand-operated cable shown in circled area 2 of FIG. 1.
Figure 3:
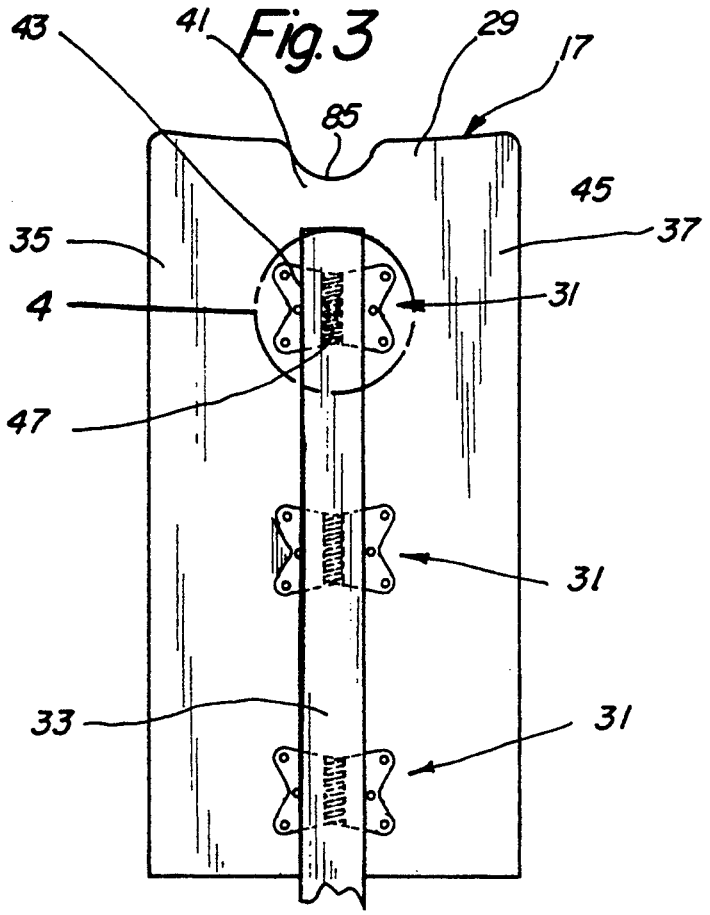
FIG. 3 is a bottom view of the bench portion of the embodiment of the swimming simulator of the invention shown in FIG. 1 taken along line 3—3 of FIG. 1.
Figure 4:
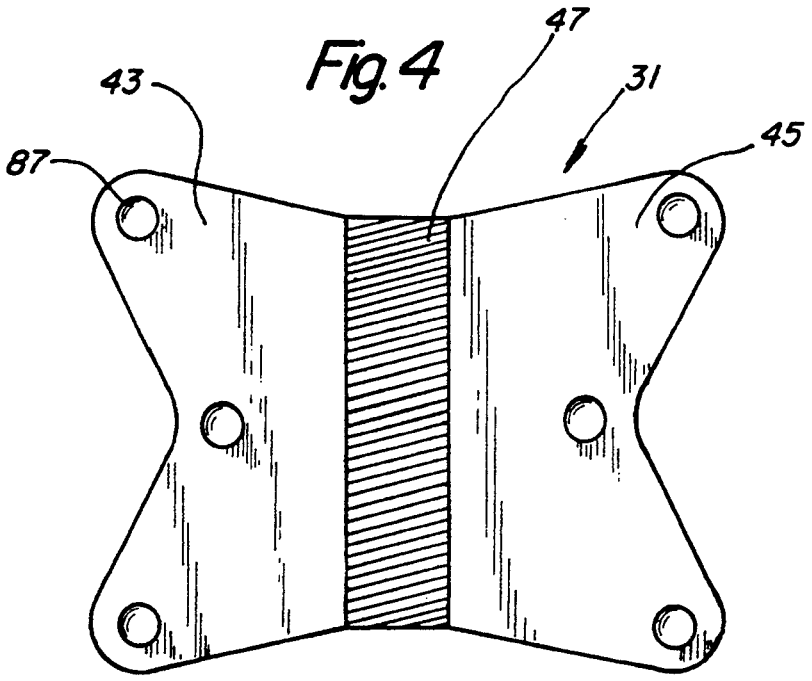
FIG. 4 is an enlarged bottom view of a butterfly spring, shown in circled region 4 of FIG. 3, used in the bench portion of the embodiment shown in FIG. 3.

With reference to the drawings, a new and improved swimming simulator embodying the principles and concepts of the present invention will be described.

Turning initially to FIGS. 1–4, there is shown a first exemplary embodiment of the swimming simulator of the invention generally designated by reference numeral 10. In its preferred form, swimming simulator 10 includes a base support assembly 11 and a pair of arm exercising assemblies 13 attached to the base support assembly 11. Each of the arm exercising assemblies 13 includes a spring-biased winding/unwinding assembly 19. A cable 21 is connected to the spring-biased winding/unwinding assembly 19, and a hand grip 23 is connected to the cable 21. A pair of leg exercising assemblies 15 is attached to the base support assembly 11. Each of the leg exercising assemblies 15 includes a leg-supporting member 25 pivotally connected to a first portion of the base support assembly 11. Each of the leg exercising assemblies 15 also includes an extensible and retractable support assembly 27 which supports a portion of the leg-supporting member 25 and which is connected to the base support assembly 11. The extensible and retractable support assemblies 27 for the leg-supporting members 25 include hydraulic cylinder and piston assemblies 27. Hinge assemblies 81 are used to connect the leg-supporting members 25 to the base support assembly 11.

A bench assembly 17 is attached to the base support assembly 11. The bench assembly 17 includes a bendable top member 29, a spring assembly 31 located under the bendable top member 29 and supported by the base support assembly 11, and a horizontal support member 33 supporting the bendable top member 29. The bendable top member 29 includes a longitudinal axis, and the horizontal support member 33 extends longitudinally beneath the longitudinal axis of the bendable top member 29. The horizontal support member 33 is supported by the base support assembly 11, such that a first portion 35 and a second portion 37 of the bendable top member 29 are elevated and lowered by the spring assembly 31 with respect to a third portion 41 of the bendable top member 29 which is supported by the horizontal support member 33. Three spring assemblies 31 are shown in use in FIG. 3. The bendable top member 29 has a recess 85 for receiving the neck and chin of a user.

Each spring assembly 31 is comprised of a butterfly spring assembly 31 which includes a first wing portion 43 positioned under the first portion 35 of the bendable top member 29. A second wing portion 45 is positioned under the second portion 37 of the bendable top member 29, and a spring portion 47 is connected between the first wing portion 43 and the second wing portion 45, for biasing upward motion of and for resisting downward motion of the first wing portion 43 and the second wing portion 45 and the spring portion 47, for biasing upward motion of and for resisting downward motion of the first portion 35 and the second portion 37 of the bendable top member 29. The resistance to the motion of the first portion 35 and the second portion 37 of the bendable top member 29 provided by the first wing portion 43 and the second wing portion 45, respectively, of the butterfly spring assembly 31 provides exercise for a user's torso as the user inhales and exhales during breathing. The first wing portion 43 and the second wing portion 45 can be attached to the first portion 35 and the second portion 37 of the bendable top member 29 by rivets 87, adhesives, or other fasteners.

In operation, a user lies down on the bendable top member 29 of the bench assembly 17 with the user's torso on the bendable top member 29. The user's legs are supported by the leg-supporting members 25. The user grasps the hand grips 23 and pulls on the cables 21. Straps 83 may be located at the ends of the leg-supporting members 25 for providing comfortable control of the leg-supporting members 25 by the user's legs. The straps 83 may employ adjustable hook-or-loop material such as VELCRO TM. The user simulates swimming motion by alternately raising and lowering arms against the resistance of the springs in the spring-biased winding/unwinding assembly 19, by raising and lowering legs as in a flutter kick motion against the extensible and retractable hydraulic support assemblies 27, and by inhaling and exhaling against the resistance of the butterfly spring assembly 31.

Figure 5:
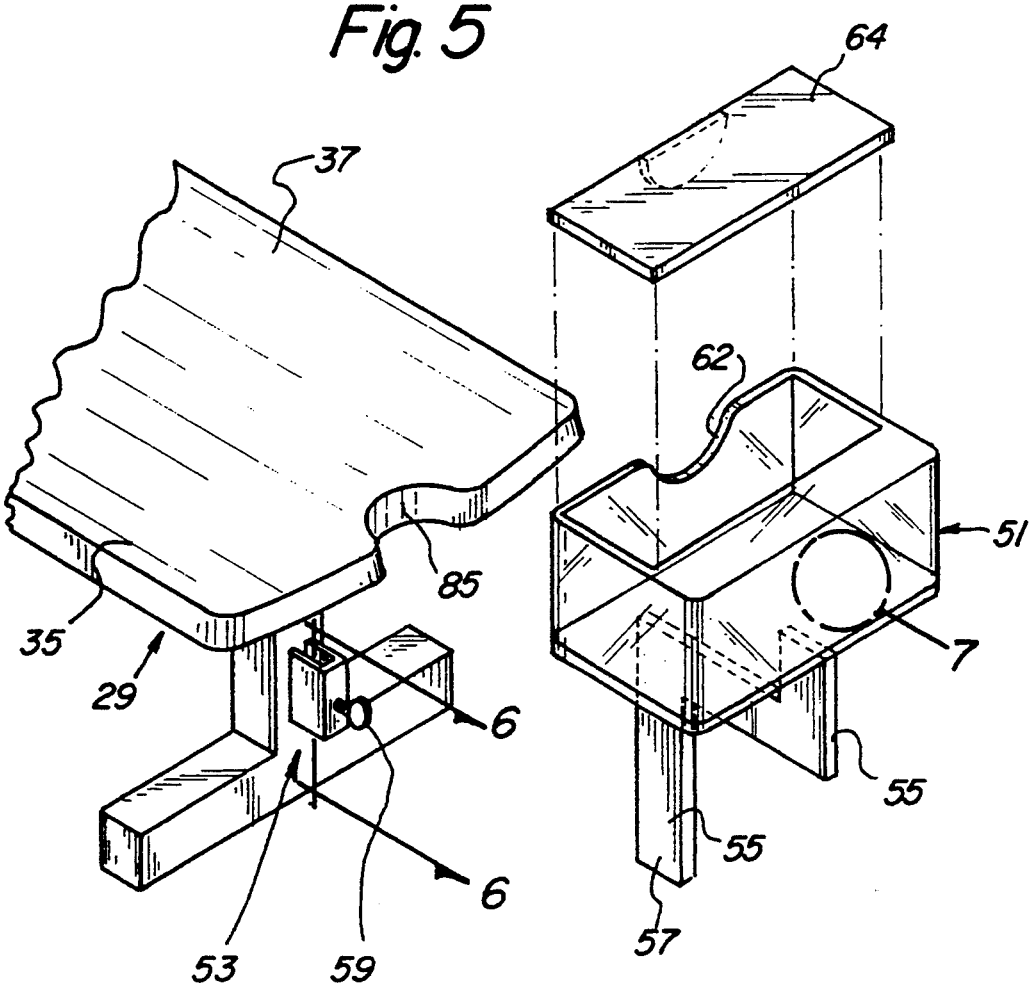
FIG. 5 is a partially exploded, partial perspective view, from above, of a second embodiment of the swimming simulator of the invention showing a small water-containing container assembly.
Figure 6:
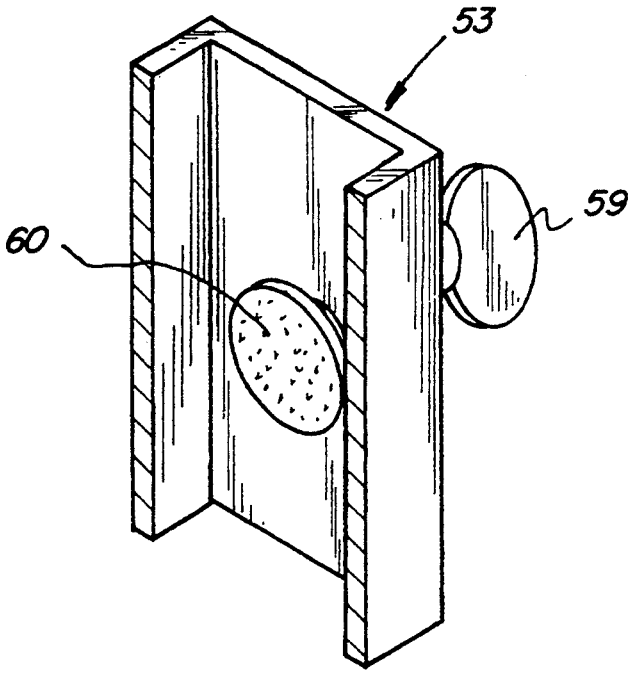
FIG. 6 is an enlarged perspective view, taken along line 6—6 in FIG. 5, of a connector assembly for connecting the container assembly shown in FIG. 5 to a bench support leg.

Turning to FIGS. 5–6, a second embodiment of the invention is shown. Reference numerals are shown that correspond to like reference numerals that designate like elements shown in the other figures. In addition, a water container 51, attached to the base support assembly 11 and positioned at one end of the bendable top member 29, permits a user's face to alternately be immersed in water and be removed from water, in simulation of alternating facial contact with water such as occurs in actual swimming. A screw clamp assembly 53 is attached, such as by welding, to the base support assembly 11. A water container support member 55 is attached to the bottom of the water container 51 and supports the water container 51 thereon. The bottom portion 57 of the water container support member 55 is placed within the screw clamp assembly 53 and is secured to the screw clamp assembly 53 by thumbscrew 59. Teeth 60 on one end of the thumbscrew 59 can assure a good grip on the support member 55. A recess 62 on one of the walls of the water container 51 is provided to accommodate the chin and neck of the user. A lid 64 can be placed on the water container 51 when the water container 51 is not in use.

Figure 7:
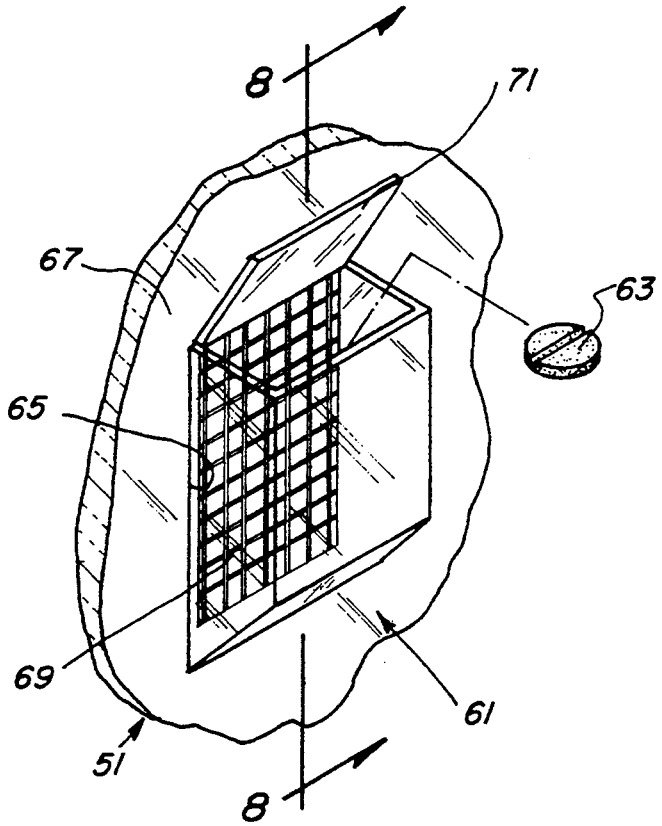
Figure 8:
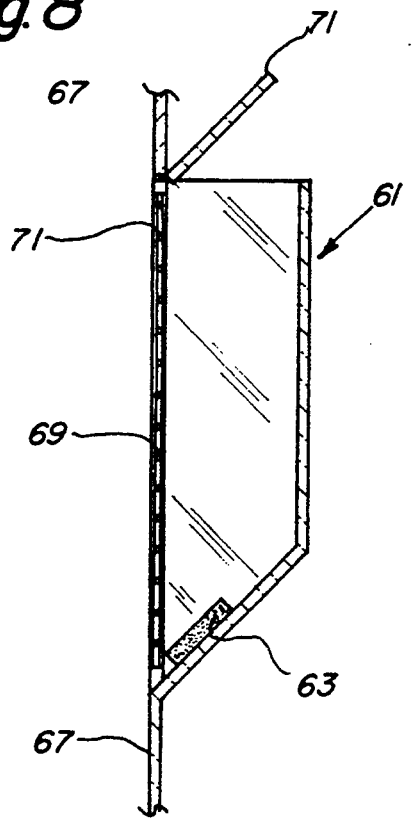
FIG. 8 is an enlarged cross-sectional view of the chemical dispensing chamber shown in FIG. 7 taken along line 8—8 thereof.

Turning to FIGS. 7–8, a third embodiment of the invention is shown. Reference numerals are shown that correspond to like reference numerals that designate like elements shown in the other figures. In addition, a dispenser compartment 61 is attached to the water container 51, for receiving a quantity of a chemical additive 63, for dissolution in water in the water container 51. An aperture 65 is formed in one wall 67 of the water container 51, and a screen 69 is placed within the aperture 65. Water in the water container 51 is permitted to intermingle with water in the dispenser compartment 61 through the screen 69, whereby the chemical additive 63 added to the dispenser compartment 61 is permitted to dissolve and mix with water in the water container 51. A lid 71 is provided for the dispenser compartment 61. The chemical additive 63 can be a chlorine-containing tablet such as is added to a swimming pool, whereby the water in the water container 51 that contacts the face of the user simulates swimming pool water. The walls of the water container 51 and the dispenser compartment 61 can be made from transparent glass or plastic materials.

The components of the swimming simulator of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved swimming simulator that is low in cost, relatively simple in design and operation, and which may advantageously be used to permit a range of hand motion that is more diverse than a purely rotational motion. With the invention, a swimming simulator is provided which does not employ flywheels which conserve momentum. With the invention, a swimming simulator is provided which is provided with hand grips attached to cables that wind and unwind reel assemblies and is also provided with a table to permit the person to be oriented in a supine position. With the invention, a swimming simulator is provided which has specific provisions for exercising a person's torso. With the invention, a swimming simulator is provided which provides specific resistance to chest muscles during chest expansion. With the invention, a swimming simulator is provided which permits a user to practice and simulate inhaling fresh air and exhaling used air in water to more accurately simulate the act of swimming. With the invention, a swimming simulator is provided which has a small quantity of water that is used for swimming simulation and that can be appropriately treated so as to simulate a selected water environment.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved swimming simulator, comprising:

a base support assembly, a pair of arm exercising assemblies attached to said base support assembly, each of said arm exercising assemblies including a spring-biased winding/unwinding assembly, a cable connected to said spring-biased winding/unwinding assembly, and a hand grip connected to said cable, a pair of leg exercising assemblies attached to said base support assembly, each of said leg exercising assemblies including a leg-supporting member pivotally connected to a first portion of said base support assembly, each of said leg exercising assemblies also including an extensible and retractable support assembly which supports a portion of said leg-supporting member and which is connected to said base support assembly, and a bench assembly attached to said base support assembly, said bench assembly including a bendable top member which includes a longitudinal axis, a spring assembly located under said bendable top member, and a horizontal support member which extends longitudinally beneath said longitudinal axis of said bendable top member, supporting said bendable top member, said horizontal support member supported by said base support assembly, such that a first portion and a second portion of said bendable top member are elevated and lowered by said spring assembly with respect to a third portion of said bendable top member which is supported by said horizontal support member.

2. The swimming simulator described in claim 1 wherein said extensible and retractable support assemblies for said leg-supporting members include hydraulic cylinder and piston assemblies.

3. The swimming simulator described in claim 1 wherein said spring assembly is comprised of a butterfly spring assembly which includes:

a first wing portion positioned under said first portion of said bendable top member, a second wing portion positioned under said second portion of said bendable top member, and a spring portion, connected between said first wing portion and said second wing portion, for biasing upward motion of and for resisting downward motion of said first wing portion and said second wing portion and said spring portion, for biasing upward motion of and for resisting downward motion of said first portion and said second portion of said bendable top member.

* * * * *